United States Patent [19]

Loose et al.

[11] Patent Number: 5,006,077

[45] Date of Patent: Apr. 9, 1991

[54] INSULATION DISPLACING BARREL TERMINAL

[75] Inventors: Winfield W. Loose, Lingelstown; James W. Robertson, Oberlin; Francis J. Shay, Palmyra, all of Pa.

[73] Assignee: AMP Incorporated, Harrisburg, Pa.

[21] Appl. No.: 386,475

[22] Filed: Jul. 28, 1989

Related U.S. Application Data

[63] Continuation-in-part of Ser. No. 211,483, Jun. 24, 1988, abandoned.

[51] Int. Cl.[5] ..... H01R 4/24

[52] U.S. Cl. ..... 439/409; 439/395

[58] Field of Search ..... 439/389–410, 439/417–419, 713, 725, 796

[56] References Cited

U.S. PATENT DOCUMENTS

| | | | |
|---|---|---|---|
| 3,351,889 | 11/1967 | Lawlor et al. | 439/409 |
| 3,877,773 | 4/1975 | Doty et al. | 439/413 |
| 4,536,049 | 8/1985 | Milmes | 439/409 |
| 4,705,340 | 11/1987 | Loose | 439/395 |
| 4,734,061 | 3/1988 | Randall, Jr. et al. | 439/709 |
| 4,795,364 | 1/1989 | Frantum et al. | 439/409 |

*Primary Examiner*—David Pirlot

*Attorney, Agent, or Firm*—Bruce J. Wolstoncroft

[57] ABSTRACT

A multiple piece terminal includes a first section which is stationary relative to the housing of the connector and rotatable sections which are rotatable relative to the first section. Each of the sections is comprised of a single thickness of metallic material wrapped into a substantially cylinderical configuration, where the rotatable sections are of a larger outer diameter than the first section such that the rotatable sections can engagingly overlie the first section. The first section is mounted to an insulative housing with a post section upstanding through the center of the first section. The post has at least one through opening which includes at least partially along its length, a frusto-conical section for wire section through the opening. The rotatable sections of the terminal has two wire receiving openings, each in communication with a wire-receiving slot around the circumference of the cylinder, with the two wire receiving openings being on opposed sides of the through opening on the post. Caps fit over the rotatable sections of the terminal, each cap has a shoulder which is engagable with a free end of a respective rotatable section of the terminal for rotation of the rotatable section of the terminal relative to the first section of the terminal. When wires are placed in through the caps and the caps are turned, the rotatable sections of the terminal are rotated and the wires are terminated in the wire-receiving slots.

38 Claims, 14 Drawing Sheets

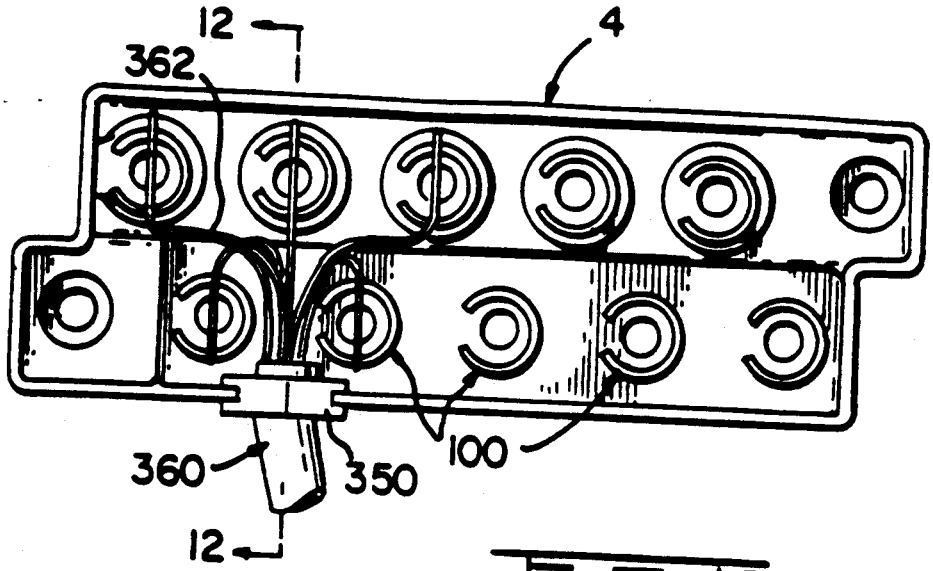
Fig. 10
Fig. 11
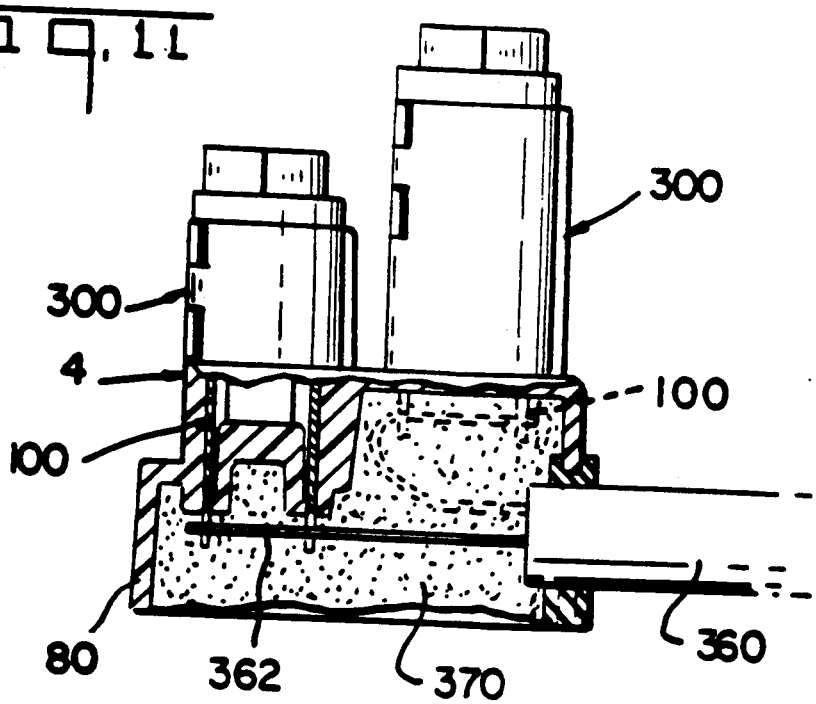

INSULATION DISPLACING BARREL TERMINAL

COPENDING APPLICATIONS

This is a continuation-in-part application of copending U.S. application Ser. No. 211,483 filed on June 24, 1988 now abandoned.

BACKGROUND OF THE INVENTION

1. Field of the Invention

The invention relates to an insulation displacement terminal having at least one wire receiving slot provided at each end thereof for the insertion of respective wires therethrough; wherein placing wires in the wire receiving openings and rotating portions of the terminal relative to the wires, terminates the wires in the wire receiving slots of the terminal.

2. Description of the Prior Art

There are many instances where terminal blocks are set up in arrays for receipt of wires therein. Many of these terminal blocks are simply threaded members fixed with insulation material which receive wires either wrapped around the threaded members and secured thereto by an application of a nut, or the wires are terminated by known spade or ring terminals and then secured to the threaded member by a nut. While these have, in some instances, provided effective means for termination, they have not always been convenient for maintenance or repair and they frequently are subjected to environmental degradation with a resulting loss of desired electrical characteristics.

There is a need, predominantly within the telecommunications industry for reusable terminals, and terminals which can accommodate more than one conductor size. The telephone wires coming from the phone company can either be in the form of buried cable or aerial wires. The terminal blocks would be mounted in either an enclosure on the aerial mount, or in an enclosed pedestal affixed to the ground, or on a pole. As new telephones are installed in a selected locality, the phone wires are then terminated to the respective terminals on the high density array.

There is also a need, particularly in applications in which the terminals are to be terminated in the field, for the terminals to be easily installed on the wires. As many wires are required for operation, it is essential that the installation of the wires be accomplished with minimal effort and minimal tooling. However, the present devices are not easily installed, and consequently, the cost of the installation is significant.

The wire sizes within the industry are not always the same gauge and therefore the terminals must be designed to accommodate more than one wire size. A typical size wire running from the terminal block to the phone installation is steel wire with a gauge of 18½ AWG, although, other phone installations use copper wire having a gauge of 22–24 AWG. It can be appreciated then, that a terminal having a higher quality means for terminating conductors and having means to accommodate more than one wire size, would be a substantial improvement within the industry. While the preferred embodiment of connector disclosed herein is for telecommunications applications, for example for electrical interconnection of tip and ring voice signals, the invention could be used with other wire sizes and in other applications.

U.S. Pat. No. 4,431,247 shows an insulated terminal and module, however the shell of the terminal only includes one wire opening for insulation displacement.

Other previous designs are shown in U.S. Pat. Nos. 4,637,675 and 4,705,340 where stationary terminals are located within housings and rotatable caps are placed over the terminals. Rotation of the cap causes the wires within the caps to be rotated into the stationary insulation displacement portions. While the previous versions shown in the '675 and '340 patents are excellent designs, these designs include shortcomings which have been addressed by the instant design.

First, this system is designed for two gauges of wire, where at least one of the wires is 18½ AWG steel. The previous designs, particularly those shown in U.S. Pat. No. 4,705,340; turn the wire into the slot relative to the axial centerline, which causes a bending of the wire. This bend, particularly in the steel wire, causes a stored energy spring effect, which over time, can attempt an anti-rotation of the cap tending to loosen the termination.

Second, as both of the previous terminal designs shown in U.S. Pat. Nos. 4,705,340 and 4,637,675 are of one piece construction, and which eventually become potted within a housing, the one-piece design leads to difficulty if one of the terminals becomes damaged and the terminals need to be replaced. To replace one of the terminals, the potting material has to be removed around the terminal, re-terminated to one of the telephone company wires, and then re-potted.

The newly designed terminal and connector which we have invented has rectified these earlier shortcomings and is summarily explained below.

SUMMARY OF THE INVENTION

The present invention utilizes insulation displacement technology to enable termination of a number of wire sizes in an environmentally protective manner with the termination being reusable and requiring only a common tool.

To overcome the first shortcoming, the effect of the springback of the steel wire, we have designed an electrical connector including an insulation displacement type connector for terminating a conductor of an insulated wire which comprises an insulating housing having at least one terminal receiving cavity defined by a cylindrical wall, and a wire receiving opening through the wall into the interior of the cavity. A cylinder is formed of a conductive material and defines a tubular wall which has at least one wire receiving entry through the wall of the cylinder which is in communication with a slot that partially extends circumferentially around the terminal. A cap is positioned adjacent to the cylinder and is rotatable with respect to the housing and has means for engaging the cylinder for simultaneous rotation of the cylinder with the rotation of the cap. In this manner, when a wire is placed within the wire receiving entry and the cap is rotated relative to the housing, the cap engages the cylinder and rotates the terminal into the wire, and terminates the conductor of the insulated wire within the slot in the terminal. Thus rather than rotating the wire into the terminal, thereby putting a bend in the wire, the wire is held stationary, and the terminal is rotated into the wire.

Also to address the first shortcoming, another aspect of the inventive connector includes an insulative base member which comprises a floor with a post upstanding from the floor, the post having a through opening for receipt of the insulative wire, at least partially therethrough. A first terminal section is receivable over the post with an interconnection means to a conductive element, with the first said section being stationary relative to the base member. A second terminal section is electrically engagable with the first terminal section and the second terminal section has a wire receiving opening in communication with a conductor terminating slot, the wire receiving opening being aligned with the through opening in the post. The connector further includes means to rotate the second said terminal section relative to the first said terminal section.

In this manner, when an insulated wire is disposed within the wire receiving opening and within the through opening of the post, and the second terminal section is rotated, the conductor receiving slot is moved into electrical connection with the conductor of the insulated wire. The post which upstands from the floor, and the opening, not only provide a bearing surface during the termination of the wire, but also provide a straight opening through the terminal which maintains the wire in the original position. This prevents a bending action which would add a stored energy spring effect causing anti rotation of the cap, and degradation to the electrical connection between the terminal and conductor.

In another aspect of the invention, our instant invention has solved the second shortcoming, that is, where the electrical terminal, when damaged, cannot be easily replaced. In this aspect of the invention, an electrical terminal comprises a first section of terminal of generally cylindrical shape having a first conductor connecting section, and a second section of terminal of generally cylindrical shape profiled for engagement with the first said section, the second section including a wire receiving opening through a wall of the section in communication with a wire receiving slot, such that when a wire is placed through the wire receiving opening and proximate to the wire receiving slot, rotation of the second section of terminal rotates the second section into the insulated conductor and terminates the conductor of said wire within the slot of the terminal.

When provided with such a design, the top portion of the terminal is removable relative to the lower portion of the terminal In this manner, if the upper portion of the terminal is damaged, the upper portion of the terminal is simply removed and thrown away. The lower portion of the terminal runs a low risk of damage as it is not moveable and it is terminated to a lower wire prior to potting. In other words, the lower terminal, if it is going to be damaged would more than likely get damaged during the termination of the lower wire; and in that event the replacement of the lower portion of the terminal is easily handled, because the lower portion is not yet potted in place.

In another aspect of the invention, our invention has simplified the installation of the terminals to the wires, thereby providing an easy and cost effective means to install the terminals on the layered cables or aerial wires. In order to facilitate the installation of the terminals on the wires, each terminal has an insulation displacement section at either end thereof. This allows the installer to terminate all the wires, including the wires of the phone company and the like, by means of rotary installation displacement techniques, thereby eliminating the need for the installer to splice the wires to an intermediate cable.

BRIEF DESCRIPTION OF THE DRAWINGS

FIG. 3 is a front plan view showing the two piece terminal of FIG. 2.

FIG. 8 is a stamped blank of the upper portion of the terminal prior to being rolled into a barrel terminal.

FIG. 10 is a bottom plan view showing the underside of the connector with the individual wires of the multi-conductor cable in a terminated condition.

FIG. 11 is a cross sectional view through lines 11—11 of FIG. 10.

DESCRIPTION OF THE PREFERRED EMBODIMENT

Figure 1:
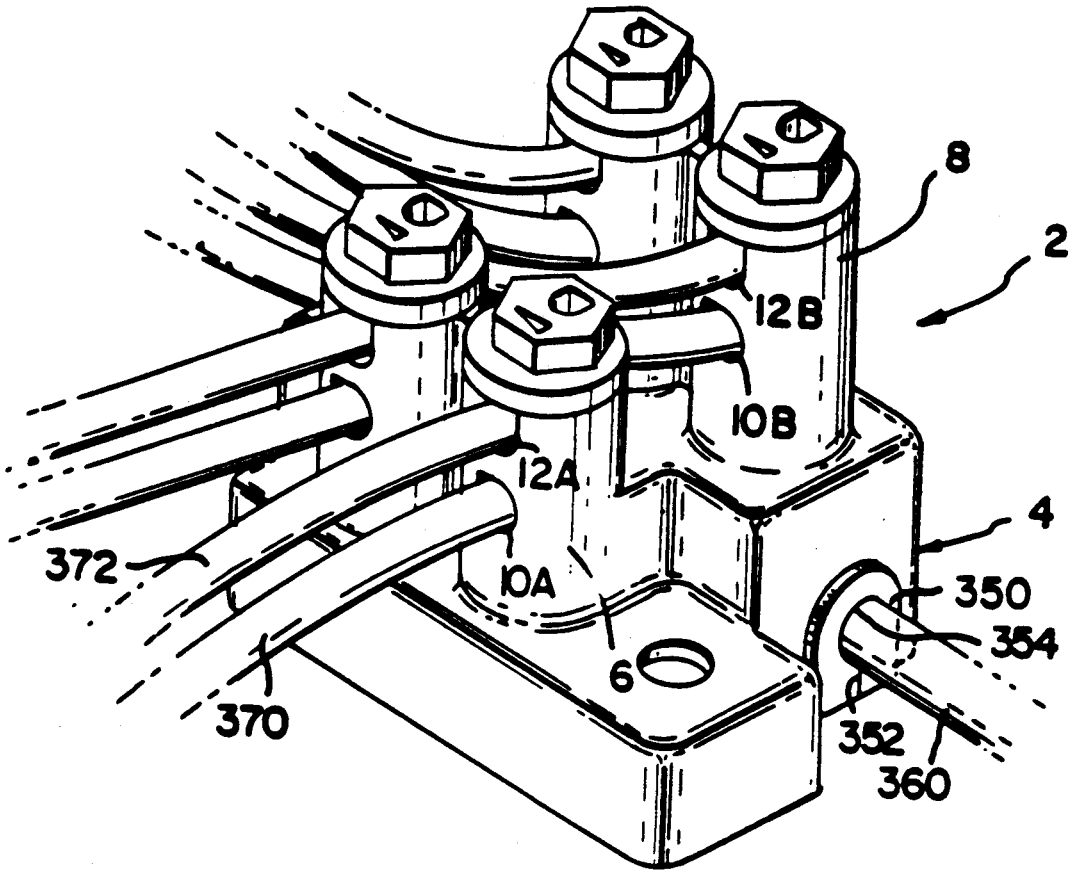
FIG. 1 is a perspective view showing a high density array of terminals and caps.

With reference first to FIG. 1, an electrical connector 2 is shown which includes an insulative housing member such as 4 including a plurality of silo members, such as 6 and 8, disposed in two opposed rows. The electrical connector is for electrical connection to individual conductors such as 362 within a multi-conductor cable 360 (FIG. 11). Either one or two other insulated conductors such as 370 and 372 can be interconnected within each silo member 6 or 8, to one another, or to a discreet one of the individual conductors 362 of the multi-conductor cable 360 upon insertion through the openings 10*a* and 12*a* as shown in FIG. 1.

Figure 6:
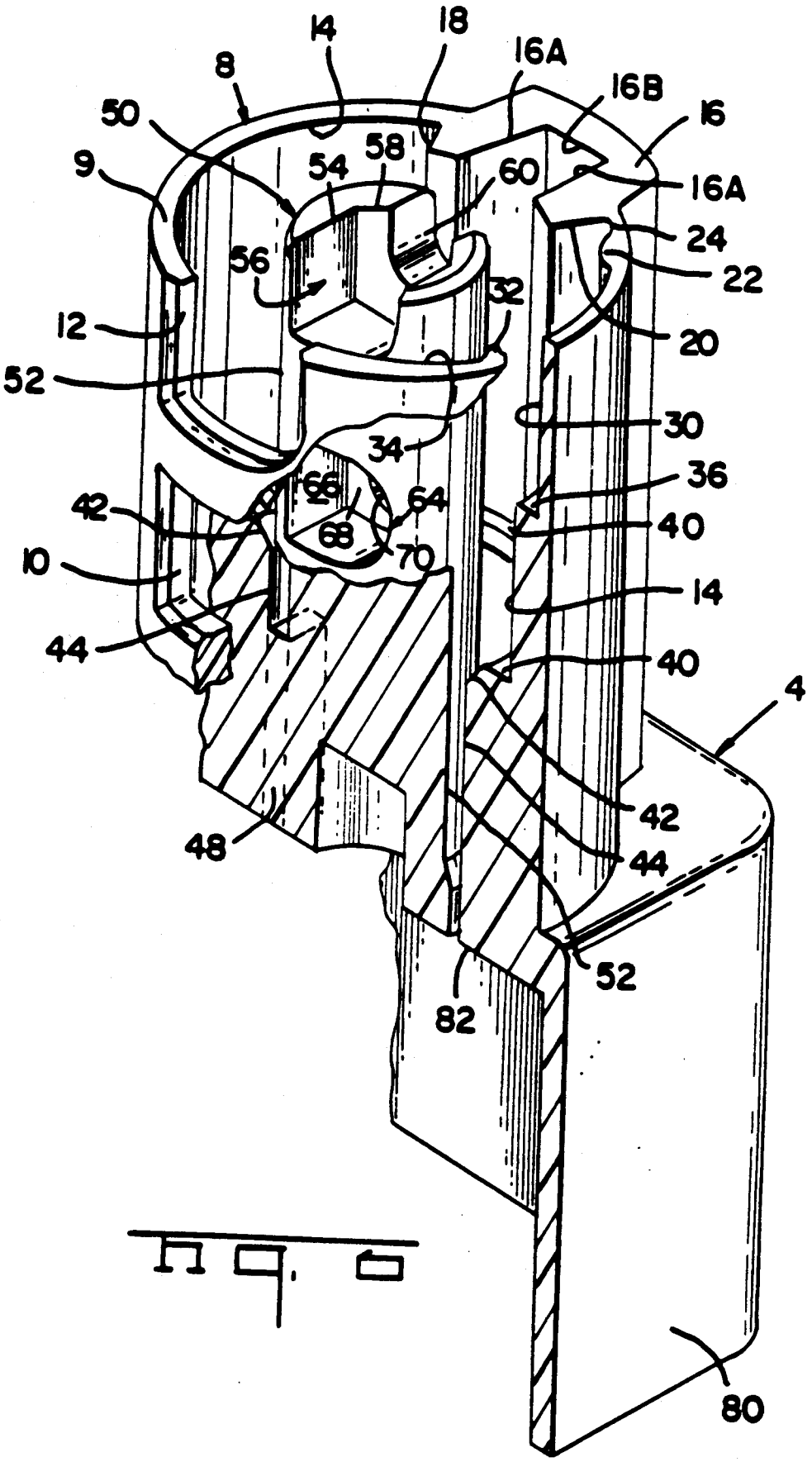
FIG. 6 is an isometric view, partially cut away, through the housing.
Figure 7:
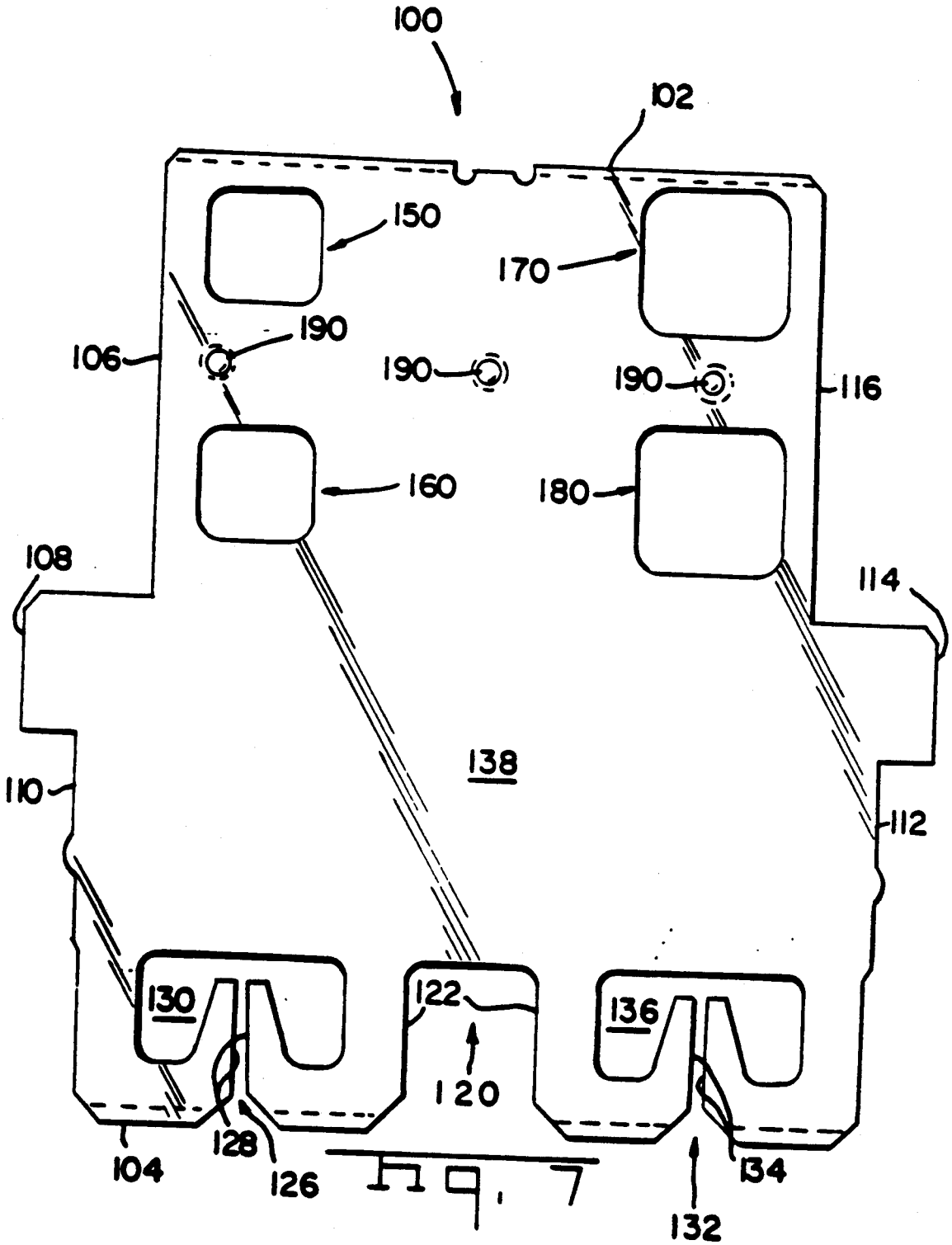
Figure 5:
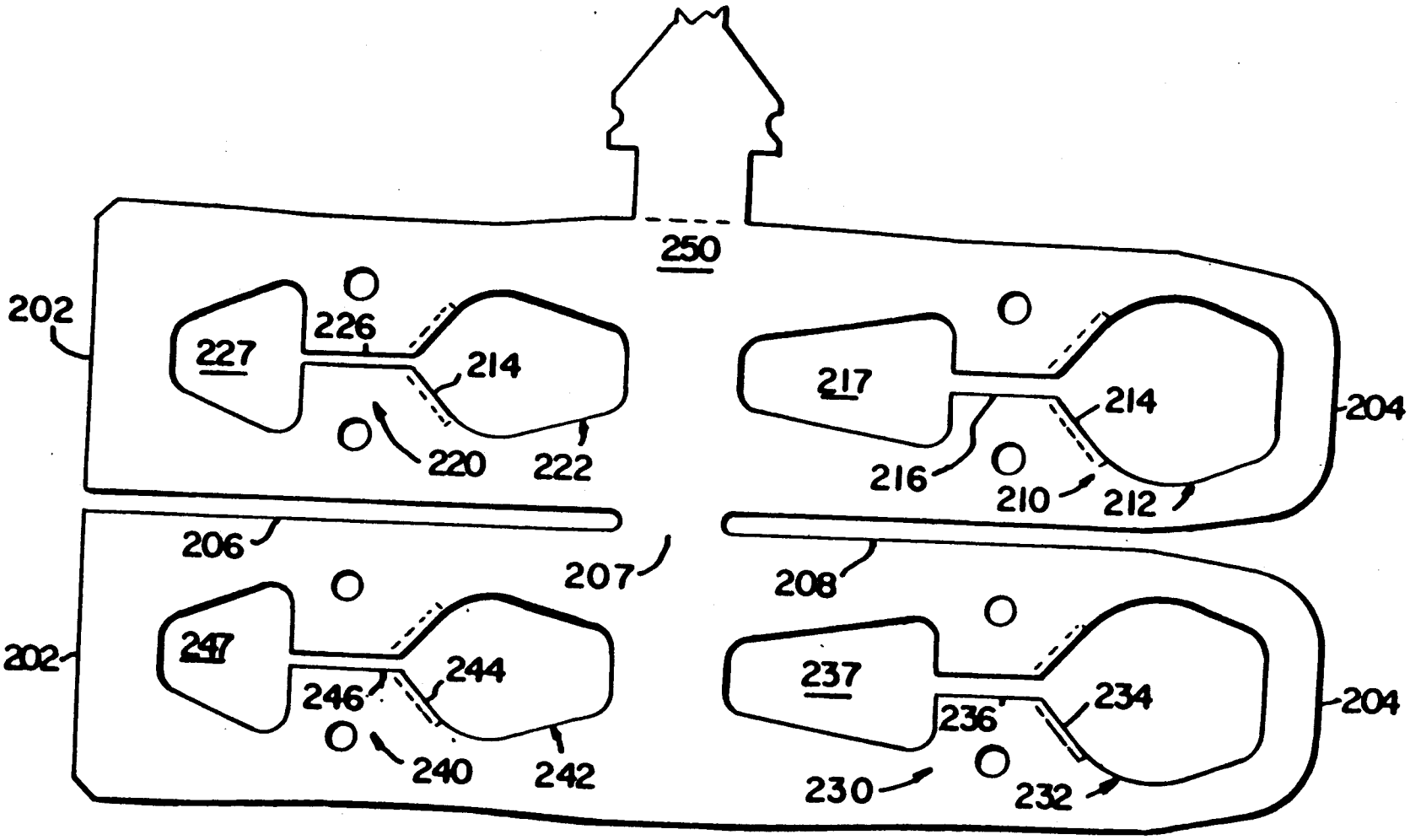

With reference now to FIG. 6, the housing member will be described in greater detail, and it should be noted that FIG. 6 shows the internal structure of silo 8 in particular, however it should be noted that the internal structure of silo 6 is identical to that of silo 8. Both silos 6 and 8 include an internal diameter such as 14 which extends circumferentially around the internal surface of the silo where it ends with stop surfaces 18 and 20. A longitudinally extending channel 16 extends along the length of the silo and includes opposed parallel surfaces 16*a* and an end surface 16*b*. Along a portion of the internal circumferential surface, proximate to stop surface 20 is a first detent member 22 which defines a recessed section 24 adjacent to the stop surface 20 and further defines a shallow surface 30. A second detent member 32 is located beyond the first detent member 22 and defines a second shallow surface 34. Surface 34 is gradually increasing in thickness from a position just beyond the detent 32, and increases in thickness upon radial movement from the detent member 32 to the opening 12. Each of the surfaces 30 and 34 extend only partially along the length of the silo thereby defining a floor such as 36 partially along the length thereof. Inner-circumferential surface 14 extends from the floor 36 downwardly to a second floor such as 40. Beneath the floor 40 is a circumferential surface 44 having a lead in such as 42.

A generally solid post member 50 is integral with the entirety of the housing 4 and integrally molded therewith via a web section shown in phantom as 48 in FIG. 6. The outer diameter of the post is shown as 52 and forms a terminal receiving area in conjunction with the inner surface 44. Two wire selector through openings 56 and 64 are included in the post and are radially and longitudinally aligned with the openings 12 and 10 in the silo of the housing respectively. The upper opening 56 includes first spaced-apart walls 54 which are in transition with a lead-in section 58 thereby leading into a slot such as 60. It should be noted that the openings 12 and 56 are in radial alignment with the center of the channel 16. The lower wire selector opening 64 includes first spaced apart walls 66 in transition with a second lead-in surface 68 which then transitions into a smaller opening 70. Similarly, the openings 10 and 64 are all in radial alignment with the center of the channel 16, relative to the center of the post 50.

Figure 7:
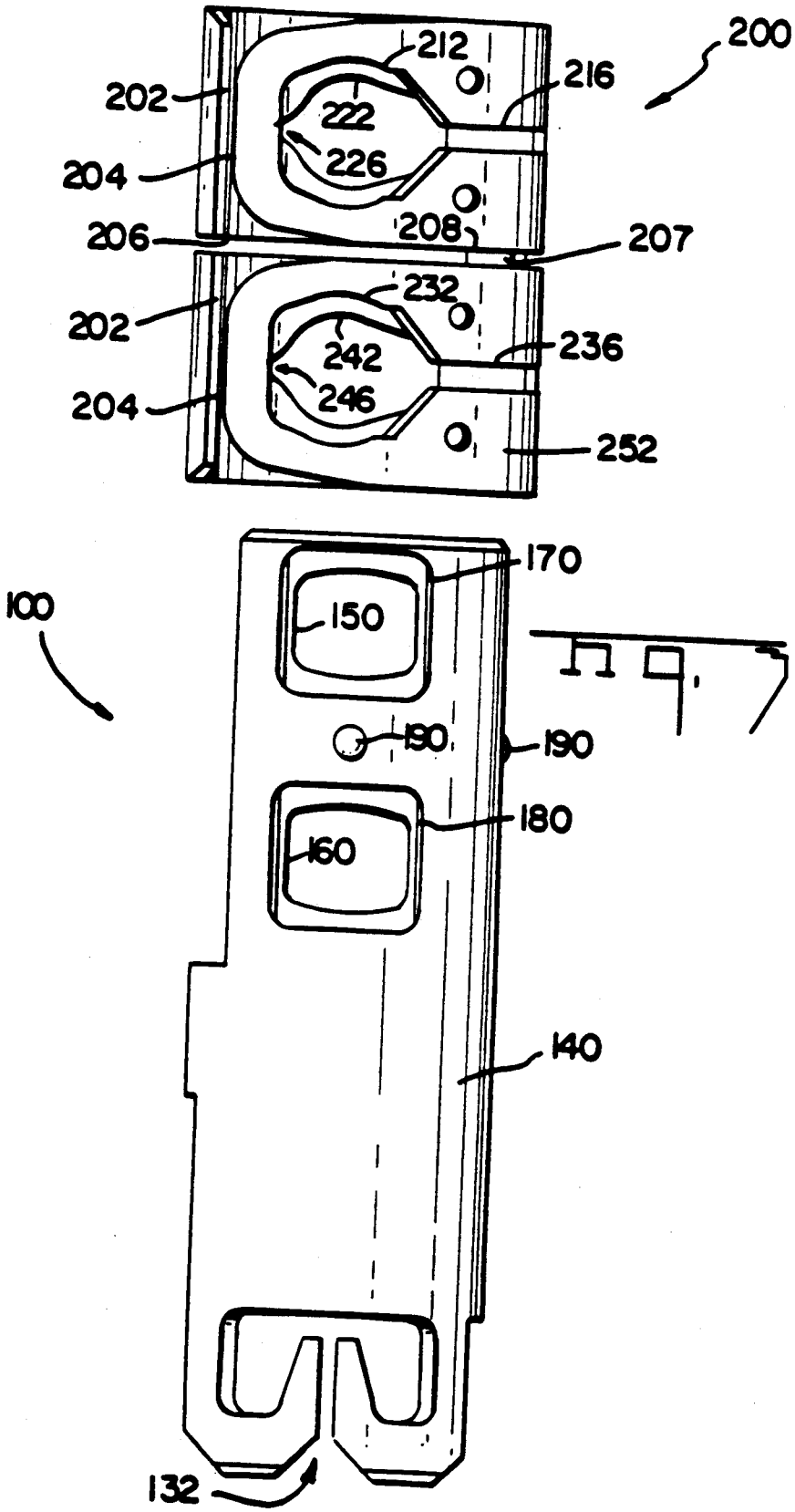
FIG. 7 is a stamped blank of the lower portion of the terminal prior to being rolled into a barrel terminal.

Referring now to FIG. 7, a lower terminal section 100 is shown as generally including an upper edge 102, a lower edge 104, side edges 106, 108 and 110 on one side thereof and side edges 116, 114 and 112 on the opposite side thereof. Wire receiving slots such as 126 and 132 are included extending upwardly from the lower edge 104 and include wire terminating edges 128 and 134, respectively. At the lower section thereof is an opening such as 120 which is defined by two parallel and opposed side edges 122; the opening 120 providing a mechanical relief area between the two wire receiving slots 126 and 132. To further prevent overstressing the lower wire receiving slots 126 and 132, recessed areas 130 and 136 are included surrounding the wire terminating edges 128 and 134, respectively.

At the upper portion of the terminal 100, two small wire openings 150 and 160 are included at the left margin, while two large wire openings 170 and 180 are included at the right hand margin. The upper section of the terminal 100 further includes three contact members 190, which when viewed from FIG. 7 would project through the bottom side of the paper rather than through the viewing side. As shown in FIG. 3, the lower section of terminal 100 when formed has side edges 114 and 108 in a substantially abutting relation such that side edges 110 and 112 and side edges 106 and 116 respectively are in a spaced apart relation with each other. It should also be noted from FIG. 3 that the pairs of large and small wire openings 170 and 150, and 180 and 160 are opposed from each other, in radial alignment through the center of the terminal.

As shown in FIG. 8, an upper section of terminal 200 is shown as including side edges 202 and 204, while a plurality of wire receiving openings and wire receiving slots are shown in communication with one another. For example, a large IDC section 210 includes a large wire receiving opening 212 in communication with a large wire terminating section 216. Further IDC sections 220, 230 and 240 are included having similar openings in communication with similar slots. Behind each of the wire receiving slots such as 216, a relief area such as 217 is included to insure that when the conductor of the wire is moved into the terminating condition, the section adjacent to the end of the wire terminating slot 216 is not overstressed. As formed in FIG. 3 the side edges 202 and 204 are brought towards each other until the shape of the terminal 200 is substantially cylindrical, although a small gap exists between their ends as explained more fully herein. It should be noted that the large wire openings 212 and 232 are opposed and in radial alignment with small wire openings 222 and 242, respectively.

Figure 5:
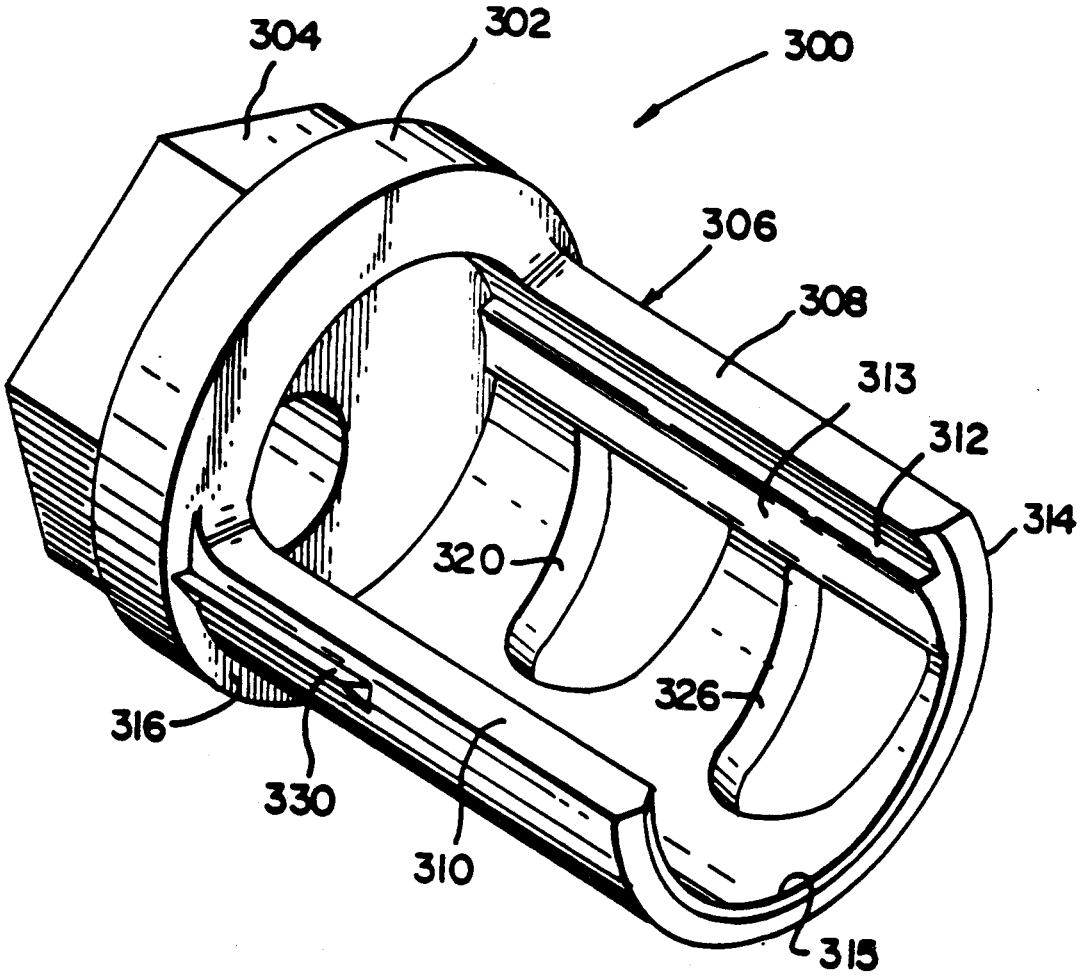
FIG. 5 is an isometric view of the cap portion.

Referring now to FIG. 5, an insulative cap 300 is shown including a circular structural portion 302 with a driver nut portion 304 integrally molded above the circular portion 302. A partially cylindrical portion 306 is integrally formed with the cylindrical portion 302 and extends downwardly therefrom having stop edges 308 and 310. A rotation bar 313 is also included on the inner surface 315 of the cap and has a forward bearing surface such as 312. Two through openings 320 and 326 in the cap extend inwardly between an outer diameter 314 and an inner diameter 315.

Figure 2:
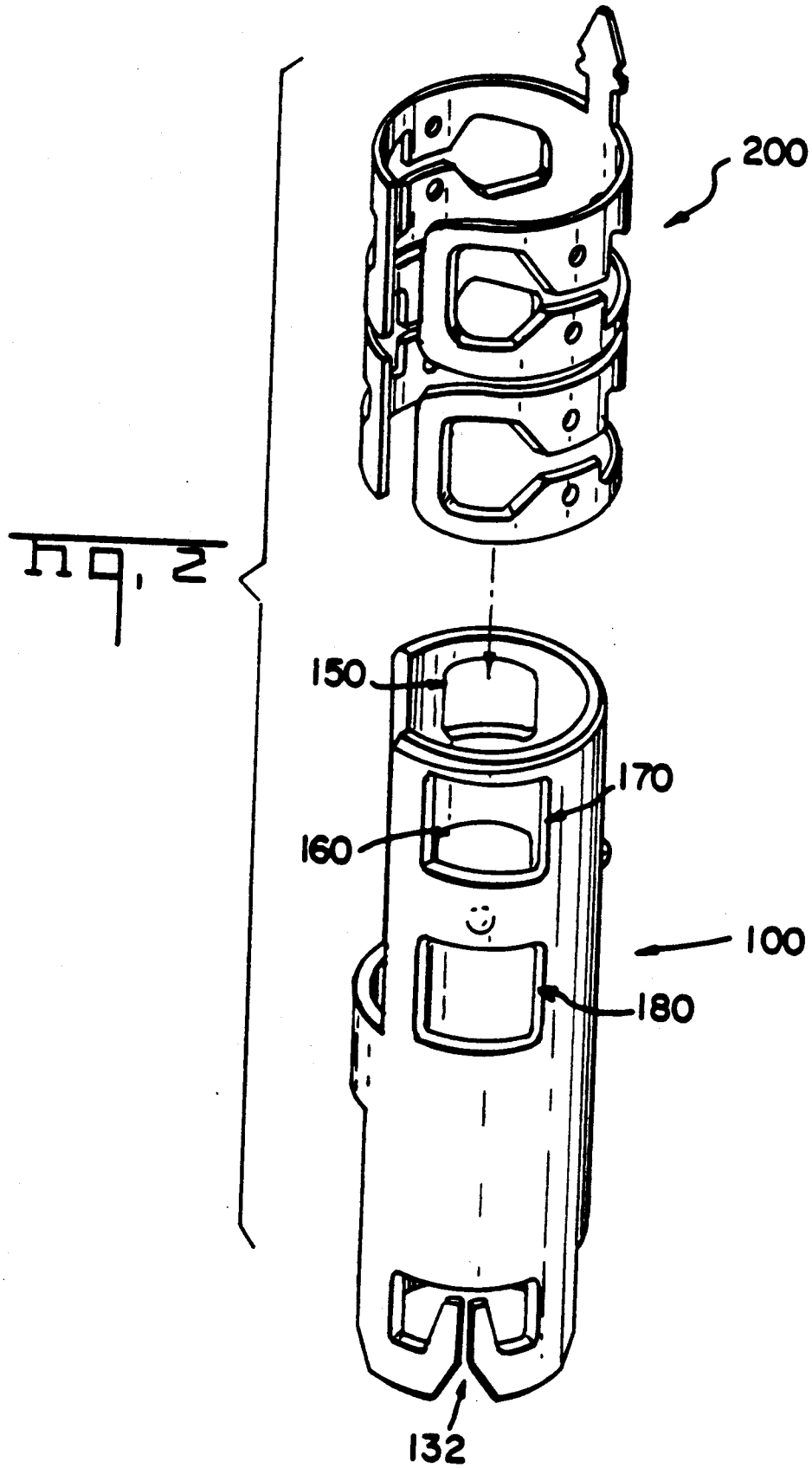
FIG. 2 is a perspective view of the subject two piece terminal exploded apart.
Figure 9:
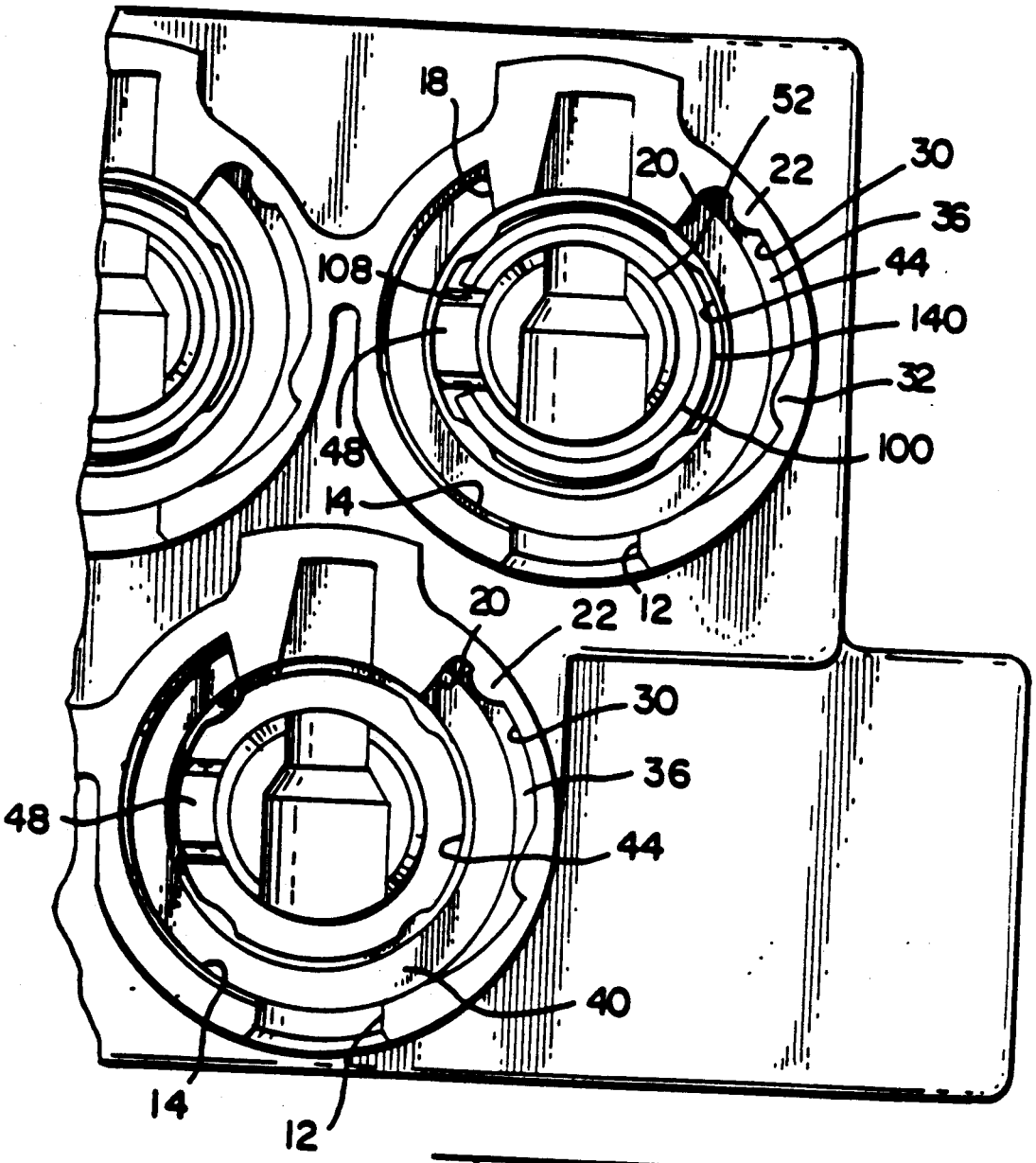
FIG. 9 is a top view of a section of the housing.

To assemble the connector with the lower section of terminal as formed in FIG. 3, the lower section 100 is inserted over the post 50 such that the opening created between side edges 110 and 112 (FIGS. 2 and 7) of the lower terminal fit over the lug 48 as shown in FIG. 6. This prevents the rotation of the lower portion 100 of the terminal during the rotation of the upper terminal portion 200. The lower section of terminal 100 is placed adjacent to the outer diameter 52 of the post 50 and adjacent to the inner diameter 44 of the silo, as shown in FIG. 9, with the wire terminating sections 126 and 132 extending beyond the surface 82 of the housing 80, as shown in FIG. 6. This also places side edges 110 and 112 adjacent to the side edges of the lug 48 to ensure that the lower section 100 remains rotationally stationary relative to the housing 4. When the lower section 100 is inserted between the silo and post, the upper edge 102 of the terminal section 100 is approximately flush with the upper edge 9 of the silo (FIG. 6) such that large openings 170 and 180 of the lower section 100 are aligned with openings 12 and 56, and with openings 10 and 64 in the silo and inner post 50, respectively.

To further complete the assembly, the upper section of terminal 200 is inserted into the cap with the gap between side edges 202 and 204 of the terminal 200 slidably received between the rotation bar 313 (FIG. 5) such that surface 202 abuts the bearing surface 312. In this manner, the outer diameter 252 (FIG. 3) of the terminal 200 will be adjacent to the inner diameter 315 of the cap. It should also be noted that with the cap and terminal assembled as just described, the openings 320 and 326 in the cap are adjacent to and in alignment with, the large wire receiving openings 212 and 232 in the upper terminal section 200, respectively.

Figure 4A:
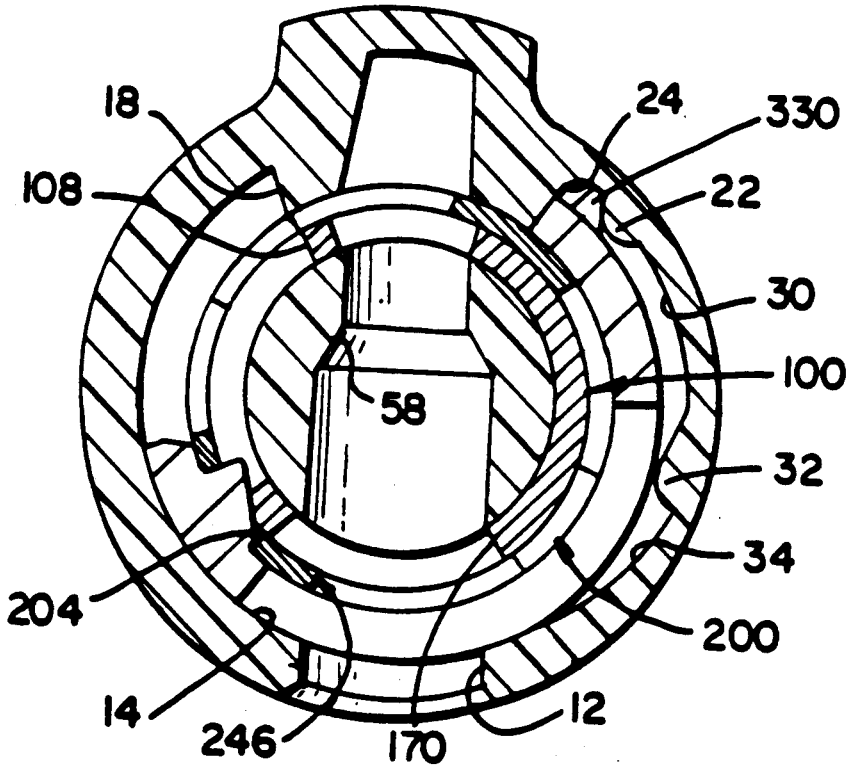
FIG. 4A is a cross sectional view through the upper insulation displacement slot showing the cap and upper terminal in the fully open position.

The cap 300 and the upper terminal portion 200 are then insertable within the individual silos between the inner surface 14 of the silos and between the outer surface 140 of the lower terminal portion. The cap 300 is placed in the silo such that the radial void between the edges 308 and 310 (FIG. 5) of the cap are between the stop surfaces 18 and 20 within the interior of the silos, and more particularly with the edge 310 of the cap in an abutting relation with the stop surface 20 such that the detent member 330 on the exterior surface of the cap is between the detent member 22 and the stop surface 20. A cross-sectional view of this position is shown in FIG. 4A. When the cap 300, and the upper 200 and lower 100 sections of terminal are in this first position, the left hand portion of the upper wire receiving opening 320 in the cap 300 is in alignment with the large wire opening 212 in the outer portion of the terminal At the same time, the left hand portion of the upper wire receiving opening 320 is in alignment with the large wire receiving opening 170 in the lower terminal 100, and with the small wire receiving opening 150 in the terminal portion 100, and with small wire opening 222 and large wire opening 212 in the terminal portion 200. Similarly, the left hand portion of the lower wire receiving opening 326 in the cap is in alignment with the openings 232, 180, 160 and 242. When the cap 302 and upper terminal portion 200 are placed within the silo such that the lower edge 316 of the section 302 is in an abutting relation with the top surface 9 of the silo, the slots 206 and 208 of the upper terminal portion are overlying the contact members 190 on the lower section of the terminal 100.

As shown in FIG. 1, the connector 2 is then prepared for field use by inserting a plug 350 having a slit 352 through the center, communicating with an aperture 354. With the plug 350 wrapped around a multi-conductor cable, such as cable 360 in FIGS. 10 or 11, the plug 350 can be inserted within the U-shaped slot 84. Each of the discreet insulated wires are then terminated to the lower insulation displacement sections 126, 132 in a conventional manner. With the housing 4 in a configuration such that the caps 300 and terminals 100, 200 are facing downwardly, the upstanding side walls 80 of the housing 4 and the end walls form a cavity with the upstanding sidewalls of the housing higher than the protruding portions of the lower sections of terminals. To environmentally protect the lower terminations, an epoxy resin 370 is poured into the cavity to completely cover the insulation displacement portions 126, 132 and the individual discreet wires 362, as shown in FIG. 11. The plug 350 retains the epoxy or encapsulating material 370 in the cavity until the epoxy has cured and also acts as a strain relief member protecting the wire terminations from tensile force on the cable. The array is then ready for field pedestal installation, or for mounting within an enclosed aerial mounting box or pole. The individual wires of the multi-conductor cable are then connected to corresponding wires of the phone company, either the buried cable or aerial drop wires.

With the connector in the configuration shown in FIG. 4A, a further discreet wire can be terminated within the connector by inserting a discreet wire such as 370 or 372 through either of the through openings 10 or 12 in the silo. If the wire is a large gauge wire, the wire will project into the connector into the interior of the post 50 as far as surfaces 58 to prevent the wire from passing through the post into the small wire terminating section. Rather, if the discreet wire to be terminated has a small gauge, the wire freely passes through the section 60 in the post, through the small wire openings 224, 244 and 150, 160 in both the upper and lower terminal sections, 200, 100, respectively and into the channel 16 as shown in phantom in FIG. 4C.

Figure 4C:
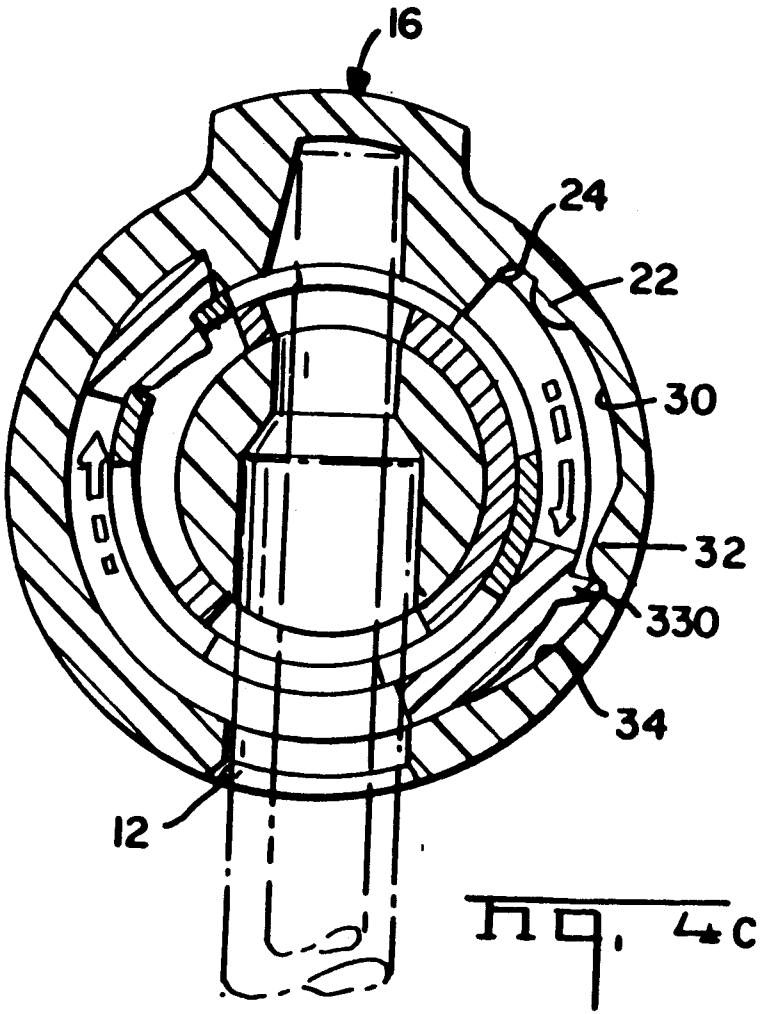
FIG. 4C is a view similar to that of FIGS. 4A and 4B showing the cap and upper terminal in the fully terminated condition.
Figure 4B:
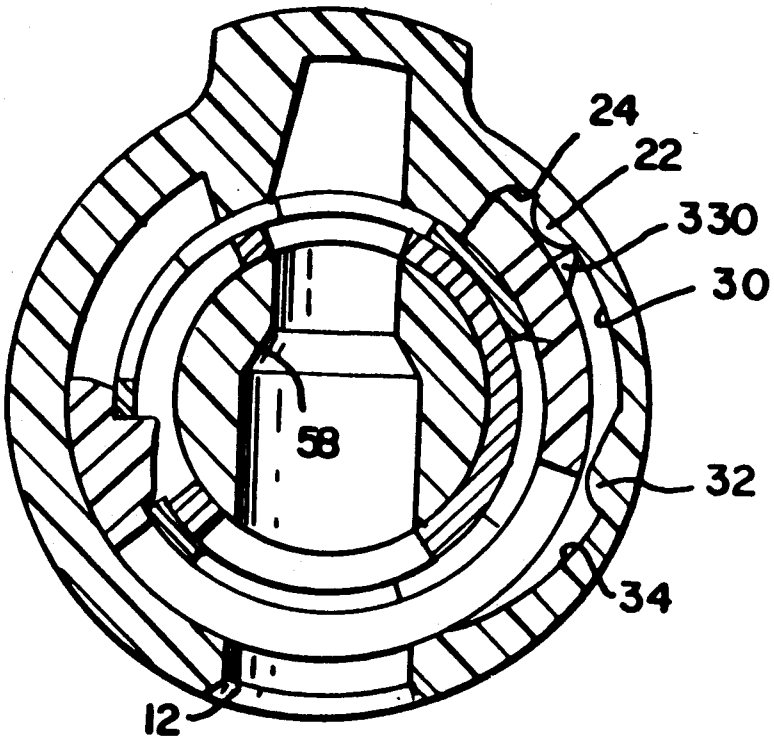
FIG. 4B is a view similar to that of FIG. 4A showing the cap through a first detent.

To terminate the wire into one of the respective slots 216–246, the cap 300 is rotated in the clockwise direction as viewed in FIGS. 4A through 4C, and as the cap is first rotated, the detent 330 on the outer surface of the cap passes the detent 22 within the interior of the silo to the position shown in FIG. 4B. Continued rotation of the cap continues the rotation of the upper terminal portion 200 until the cap is rotated to the position shown in FIG. 4C where the detent 330 is locked behind the complementary detent section 32 on the silo. With the cap rotated to the position shown in FIG. 4C, the upper section 200 of the terminal is rotated into the insulated wire such that the conductor inside the insulated wire is placed centrally within one of the wire receiving edges 216, 226, 236 or 246, depending on the gauge of wire, and depending upon which wire receiving opening, 10 or 12, the insulated wire was inserted through. It should be appreciated that the wire receiving edges 216 through 246 have gaps between them, slightly smaller than the diameter of the conductor to be terminated such that movement of the wire into the slot causes the leading edges 214 through 244 to sever through the insulation of the insulated conductor and place the bared conductor between the edges 216 through 246 in a contacting relation.

It should be appreciated that the post acts as a selector for the particular gauge of wire to be inserted within the terminal and it acts as a bearing surface for the anti-rotation of the wire during the termination of the wire. Further bearing surfaces are provided by the leading edges of the openings 170, 180, 150 and 160 in the lower terminal portion 100, and against the leading edges of the openings 12 and 10, and of the channel 16. It should also be noted from the progression of FIGS. 4A through 4C that the wire remains in a straight condition during the termination thereof. Finally, the two piece terminal allows one terminal portion 100 to be fixed, while allowing the second terminal portion 200 to rotate relative to the first portion 100, yet maintain electrical continuity between the two by virtue of the raised projections 190 on the terminal portions 100 being in contact with the slots 206 and 208 in the upper terminal portion 200. The upper 200 and lower 100 terminal portions are kept in electrical engagement by the close proximity of the respective concentric surfaces of the post 50, the inner terminal portion 100, the outer terminal portion 200, the inner and outer surfaces of the cylindrical portion 306 of the cap 300 and the inner surface 14 of the silo 6 or 8; as shown in the FIGS. 4A–4C.

Other embodiments of the invention are foreseeable without departing from the scope of the claims herein. For example, the two opposed slots 216, 226; and 236, 246 on opposite sides of the outer 200 terminal could be sized for terminating the same sized wire; thus instead of alternately terminating two wire sizes, the wire always protrudes through to the channel 16 and the wire is terminated within two slots, thereby providing for a redundant interconnection.

Figure 12:
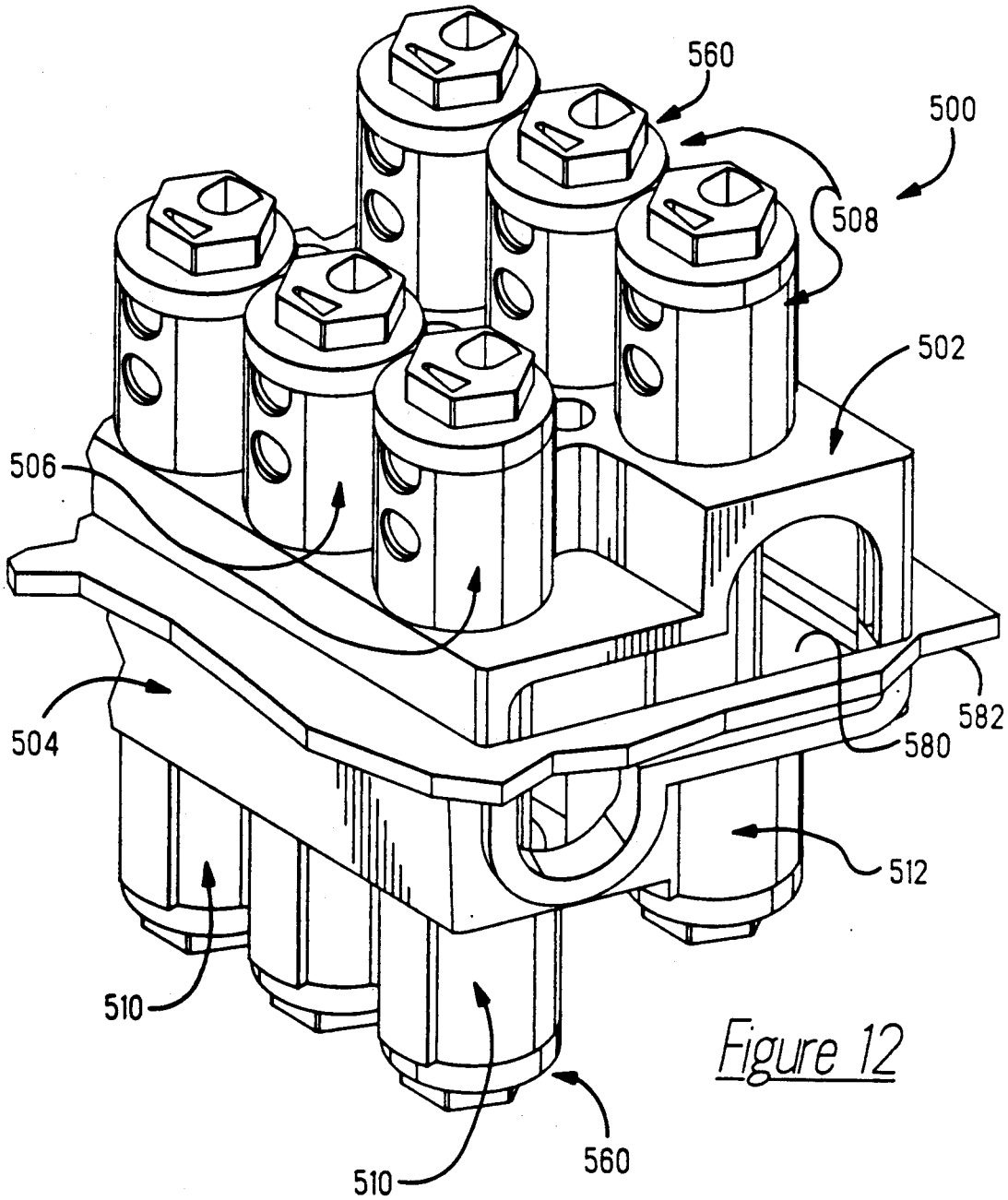
FIG. 12 is a perspective view of an alternate embodiment of the invention showing a high density array of terminals and caps, the terminals having caps provided at either end thereof.
Figure 13:
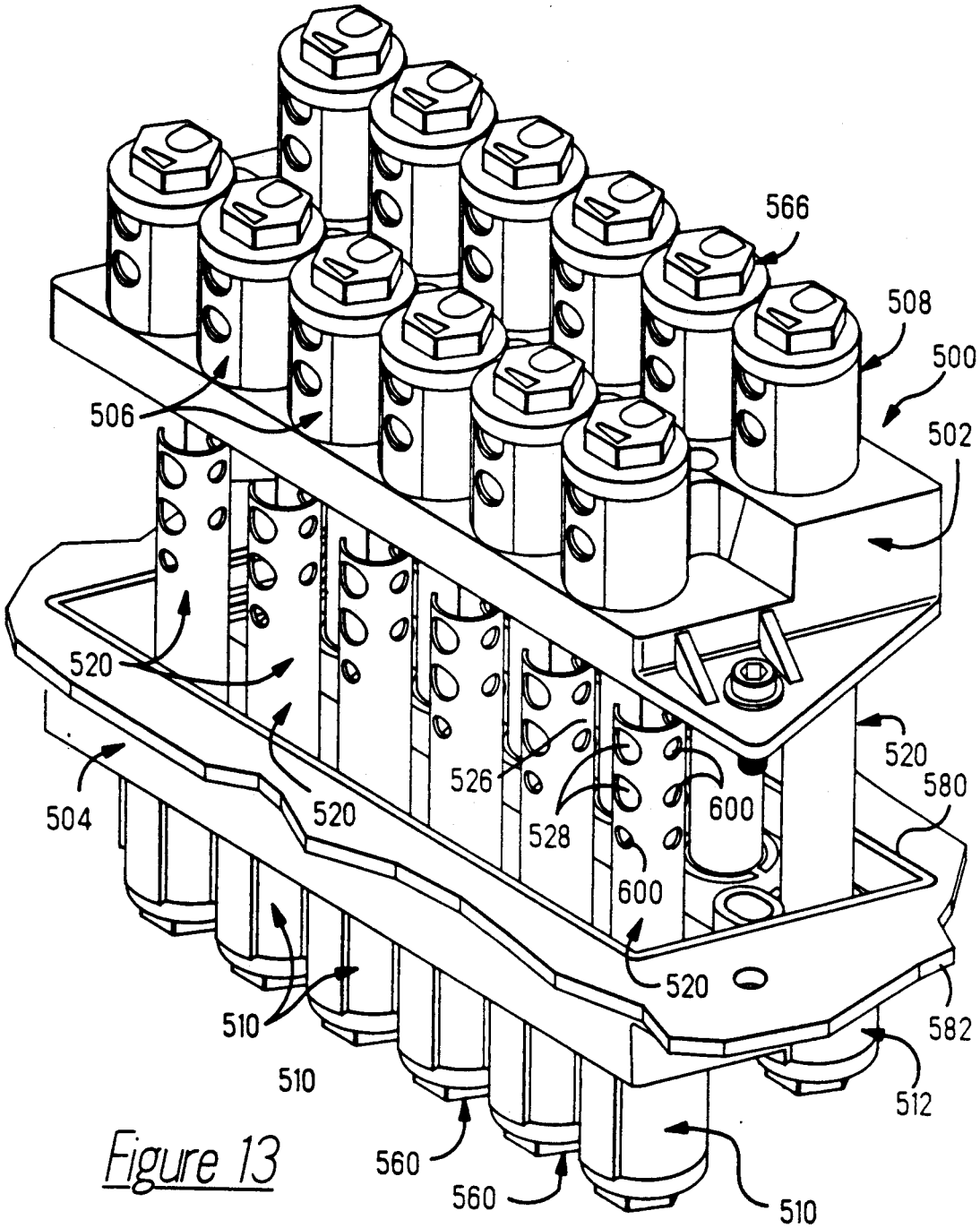
FIG. 13 is an exploded view of the high density array of terminals and caps shown in FIG. 12.
Figure 14:
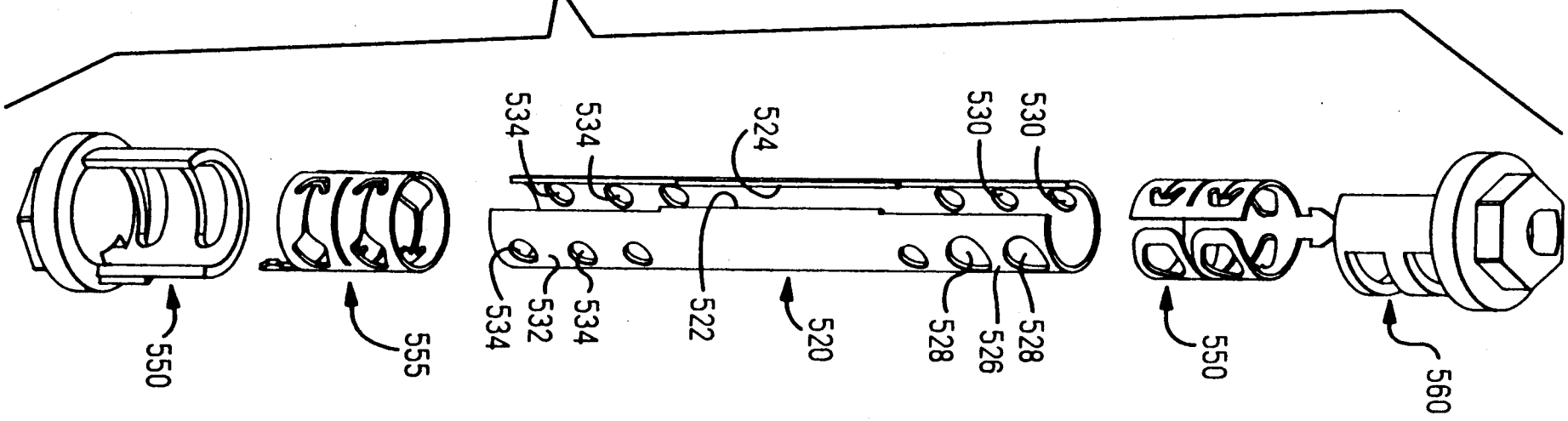
FIG. 14 is an exploded perspective view of the terminal provided in the high density array of FIG. 12.

With reference to FIGS. 12 through 14, an alternate embodiment of the invention is shown. An electrical connector 500 has a first insulative housing half 502 and a second insulative housing half 504. The first insulative housing half 502 includes a plurality of silo members 506, 508 disposed in two rows. The second insulative housing half 504 also includes a plurality of silo members 510, 512 disposed in two rows. As is best shown in FIG. 12, the silo members 506, 508 are provided in alignment with respective silo members 510, 512. It is worth noting that the housing halves 502, 504 can be molded as one piece, or in the alternative can be molded as two distinct pieces which are mounted together in some conventional manner.

Each silo member has an internal structure essentially identical to the internal structure of silo 8 previously described. Therefore a detailed description of silo members 506, 508, 510, 512 will not be provided.

Referring now to FIG. 14, a base or lower terminal section 520 is shown in the formed position. As is shown, the side edges 522 and 524 are positioned so that the edges are provided in substantially abutting relationship. It should be noted that an upper portion 526 (as viewed in FIG. 14) of the lower terminal section 520 have large wire openings 528 which are provided in alignment with respective small wire openings 530, thereby providing the means required to accept the various wire sizes which will be provided in the connector, as was previously discussed. In contrast, the lower portion 532 of the lower terminal section 520 has only a plurality of small openings 534 provided thereon. The openings 534 provided in the lower portion 532 are utilized to terminate the respective discrete insulated wires of the cable supplied by the phone company. Consequently, as only one size wire is utilized, the openings provided can all be of the same configuration, thereby providing the terminals with a means to provide redundant contact points.

The lower terminal sections 520 are inserted into the electrical connector 500 through respective silos. Each terminal is positioned in alignment with a silo and inserted through the end thereof. Insertion is continued until the ends of the terminal are approximately flush with the ends of the respective silos. With the terminals fully inserted into the electrical connector, a potting material is inserted into an inner cavity of the housing halves 502, 504 through an end thereof. The potting material provides the environmental seal required. In the alternative, if the housing halves 502, 504 are sealed together, no potting or encapsulant material is required, as no environmental seal or holding means is required.

The operation and installation of upper sections 550, 555 and caps 560 are essentially identical to the operation of upper sections 200 and caps 300. Therefore, a further explanation of these various parts will not be undertaken. However, as shown in FIG. 14, sections 550, 555 and caps 560 are provided at either end of the lower terminal sections 520. This allows the rotary IDC type termination to be used at either end of the terminal. Sections 550 and 555 are essentially identical, with the exception that the only one size slot is provided in section 555.

With electrical connector 500 fully assembled, the electrical connector is installed in an opening 580 of a substrate 582, as is best shown in FIG. 12. Mounting of the connector onto the substrate is done by any conventional mounting means. The mounting of the electrical connector 500 on the substrate 582 allows the the silos on either side of the electrical connector to be easily accessed.

An advantage which is provided by the embodiment shown in FIGS. 12 through 14 relates to the ease of installation of the electrical connector 500 in field applications. In contrast to the embodiment described in FIGS. 1 through 11, no preparation of the connector is required prior to the connectors use in the field. In other words, in the embodiment shown in FIGS. 12 through 14, there is no need to terminate the terminals to a intermediate multi-conductor cable which must then be environmentally protected by the use of an epoxy or encapsulant. Rather, the wires of the phone company are connected directly to the terminals of the electrical connector, eliminating the need for the intermediate cable. Allowing the phone wires to be terminated directly to the terminals also provides the installer with an easier method of termination. Rather than being required to splice wires together, the installer inserts the wires into the openings, rotates the cap, and the wires are terminated, thereby requiring much less time to terminate the wires.

Another advantage of the embodiment shown in FIGS. 12 through 14 relates to openings 600. The openings 600 are positioned to weaken the strength of the metal used in the manufacture of the terminals. In order to insure that the terminals have the appropriate characteristics required for operation, a copper-nickel-tin alloy (such as CNS 725) is used to manufacture the terminals. This type of alloy is relatively strong and therefore, difficult to bend. The removal of the metal from openings 600 sufficiently weakens the metal so that the metal may be formed in the configuration desired. The removal of the metal also reduces the overall cost of the terminals, as the removed scrap metal can be reused. The positioning and the number of openings provided on various terminals is dependent on the characteristics of the metal used and the final configuration desired for the terminals.

Changes in construction will occur to those skilled in the art and various apparently different modifications and embodiments may be made without departing from the scope of the invention. The matter set forth in the foregoing description and accompanying drawings is offered by way of illustration only.

The invention was described by way of preferred embodiment but should not be taken to limit the scope of the claims which follow.

What is claimed is:

1. An insulation displacement type connector for terminating a conductor of an insulated wire thereto, comprising:

an insulating housing having at least one terminal receiving cavity defined by a cylindrical wall, and a wire receiving opening through the wall into the interior of the cavity;

a cylinder formed of a conductive material defining a tubular wall, said cylinder having at least one wire receiving entry through the wall of the cylinder which is in communication with a slot that partially extends circumferentially around a terminal, and a cap which is positioned adjacent to the cylinder and rotatable with respect to the housing, having means for engaging the cylinder for simultaneous rotation of the cylinder with the rotation of the cap;

whereby, when a wire is placed within the wire receiving entry and the cap is rotated relative to the housing, the cap engages the cylinder thereby rotating the terminal into the wire thereby terminating the conductor of said wire within the slot in the terminal.

2. The connector of claim 1 wherein the cylinder further comprises a second wire receiving entry through the wall of the cylinder, which is in communication with a second slot that partially extends circumferentially around the terminal.

3. The connector of claim 2, wherein the second wire receiving entry is directly opposed from said first wire receiving entry.

4. The connector of claim 2, wherein the first said wire receiving opening and first slot are larger than the second said wire receiving opening and second slot, whereby a larger gauge wire may be terminated in the first said wire receiving opening and first slot, than in the second said wire receiving opening and second slot.

5. The connector of claim 4 wherein a post extends upwardly from the insulating housing and is profiled for concentric placement within the conductive cylinder, the post having a through opening in alignment with the wire receiving opening of the conductive cylinder.

6. The connector of claim 5 wherein the through opening in the post is in at least one section defined as a frusto-conical surface, converging inwardly towards the second smaller wire receiving opening; whereby when a large wire is placed into the through opening, the frusto-conical surface stops the large wire from entry into the small wire receiving opening, whereas, when a small wire is placed into the through opening, the wire travels freely through the through opening into the second small wire receiving opening.

7. The connector of claim 1 wherein the cap has channel means in alignment with and opposed to the opening in said cap, allowing the small wire to extend radially through the second said wire receiving opening and beyond the outer diameter of the tubular wall.

8. The connector of claim 7, wherein the channel means comprises a channel extending longitudinally of said cap, said channel having side walls and an end wall, said end wall extending radially further than said annular wall of said cap.

9. The connector of claim 1 wherein the terminal receiving cavities of the insulation housing extend from a first surface of the connector to a second surface of the connector, at least one wire receiving opening is provided proximate the first surface, and at least one wire receiving opening is provided proximate the second surface.

10. The connector of claim 9 wherein the cylinder has a first end provided proximate the first surface of the connector and a second end provided proximate the second surface, the cylinder having at least one wire receiving entry provided proximate each end thereof.

11. The connector of claim 10 wherein respective caps are positioned adjacent to the first and the second ends of the cylinder, the caps being rotatable relative to the housing.

12. The connector of claim 10 wherein the cylinder further comprises second wire receiving entries which are in communication with respective second slots that partially extend circumferentially around the cylinder.

13. The connector of claim 12 wherein the second wire receiving entries are directly opposed from the first wire receiving entries.

14. The connector of claim 12 wherein at least one first wire receiving opening and first slot have the same dimensions as a respective second wire receiving opening and second slot, such that a redundant termination is provided between the cylinder and the wire.

15. An electrical terminal for the electrical interconnection of two or more insulated conductors, the terminal comprising:

a first section of the terminal of generally cylindrical shape having a first conductor connecting section having an insulation piercing slot profiled for terminating said first conductor; and a second section of terminal of generally cylindrical shape having means for electrical engagement with the first said section, the second section including a wire receiving opening through a wall of the section in communication with a wire receiving slot for interconnection to a second said conductor, the first said conductor being electrically connectable to the second said conductor by means of the first and second sections via the engagement means, whereby, when a wire is placed through the wire receiving opening and proximate to the wire receiving slot, rotation of the second section of terminal rotates the second section into the insulated conductor and terminates the conductor of said wire within the slot of the terminal, thereby interconnecting the first and second said conductors.

16. The terminal of claim 15 wherein the first and second sections are electrically engaged through raised detents on one of the sections against the other of said sections.

17. The terminal of claim 16 wherein the other of said sections includes a guide means for receiving the detents in an electrically contacting relation, such that the rotation of the second said section relative to the first said section allows the detents to travel within the guide means, yet maintain electrical continuity between the first and second said sections.

18. The terminal of claim 15 wherein the first and second terminal sections are electrically engaged by means of outward projecting raised detents on the first said section in contact with edges of a peripheral slot in the second said section, the rotation of the second said section relative to the first said section causing the second said section to engagingly rotate relative to the first said section.

19. The terminal of claim 15 wherein the first section further comprises a stationary post and a rotatable member, the rotatable member having means for electrical engagement with the post, the rotatable member including a second wire receiving opening through a wall of the member in communication with the insulation piercing slot for interconnection to the first said conductor.

20. The terminal of claim 19 wherein the post and the rotatable member are electrically engaged by means of outward projecting raised detents on the said post in contact with edges of a peripheral slot in the rotatable member, the rotation of the member relative to the post causing the member to engagingly rotate relative to the post.

21. An electrical connector of the insulation displacement type for the electrical termination of an insulated wire, the connector comprising:

an insulative base member comprising a floor with a post upstanding from the floor, the post having a through opening for receipt of the insulative wire, at least partially therethrough;

a first terminal section receivable over the post with an interconnection means to a conductive element, the first said section being stationary relative to the base member;

a second terminal section electrically engagable with the first terminal section, the second terminal section having a wire receiving opening in communication with a conductor terminating slot, the wire receiving opening being aligned with the through opening in the post; and means to rotate the second said terminal section relative to the first said terminal section; whereby when an insulated wire is disposed within the wire receiving opening and within the through opening of the post, and the second terminal section is rotated, the conductor receiving slot is forced into electrical connection with the conductor of the insulated wire.

22. The connector of claim 21 wherein the second said terminal is receivable over the first said terminal section.

23. The connector of claim 22 wherein the rotation means comprises a cap of an insulative material which is operatively connected to the second said terminal section, such that rotation of the cap rotates the second terminal section.

24. The connector of claim 23 wherein the first and second terminal section are generally cylindrical in configuration.

25. The connector of claim 24 wherein the second terminal section comprises a stamped and formed terminal where the free ends of the terminal are slightly spaced apart from one another.

26. The connector of claim 25 wherein the cap includes a shoulder extending longitudinally along an interior wall of the cap for abutment with one of the free ends of the second terminal section, such that rotation of the cap causes the shoulder to drive the free end of the second terminal section.

27. The connector of claim 21 wherein the first terminal section has a first end provided proximate the floor of the connector and a second end provided proximate an oppositely facing second major surface of the connector.

28. The connector of claim 27 wherein the posts have through openings provided proximate either end thereof, respective through openings positioned proximate the first and the second ends of the first terminal section.

29. The connector of claim 28 wherein a third terminal section is electrically engagable with the first terminal section, the third terminal section having a second wire receiving opening in communication with a second conductor terminating slot, the second wire receiving opening being aligned with a respective through opening of the post.

30. The connector of claim 29 wherein means to rotate the third terminal section relative to the first section.

31. The connector of claim 29 wherein the third terminal is receivable over the first terminal section.

32. The connector of claim 29 wherein the rotation means comprises a cap of an insulative material which is operatively connected to the third said terminal section, such that rotation of the cap rotates the third terminal section.

33. The connector of claim 29 wherein the third terminal section and the first terminal section comprise a stamped and formed terminal where the free ends of the terminal are slightly spaced apart from one another.

34. An electrical terminal for the electrical interconnection of two or more insulated conductors, the terminal comprising:

a first section of the terminal of generally cylindrical shape having engagement portions provided thereon;

a second section of the terminal of generally cylindrical shape having means for electrical engagement with a respective first engagement portion of the first said section, the second section including a first wire receiving opening through a wall of said section in communication with a first wire slot for interconnection to a first conductor;

a third section of the terminal of generally cylindrical shape having means for electrical engagement with a respective second engagement portion of the first said section, the third section including a second wire receiving opening through a wall of said section in communication with a second wire slot for interconnection to a second conductor;

whereby, when the first and second conductors are placed through the respective wire receiving openings and proximate to the wire receiving slots, rotation of the second and third sections of the terminal rotates the respective sections into the insulated conductors and terminates the conductors of the wires within the slots of the terminal, there interconnecting the first and the second conductors.

35. The terminal of claim 34 wherein the first and second sections are electrically engaged through raised detents on one of the sections against the other of said sections.

36. The terminal of claim 35 wherein the other of said sections includes a guide means for receiving the detents in an electrically contacting relation, such that the rotation of the second said section relative to the first said section allows the detents to travel within the guide means, yet maintain electrical continuity between the first and second said sections.

37. The terminal of claim 34 wherein the first and third sections are electrically engaged through raised detents on one of the sections against the other of said sections.

38. The terminal of claim 37 wherein the other of said sections includes a guide means for receiving the detents in an electrically contacting relation, such that the rotation of the third said section relative to the first said section allows the detents to travel within the guide means, yet maintain electrical continuity between the first and third said sections.

* * * * *